US010809042B2

(12) United States Patent
Brooks et al.

(10) Patent No.: US 10,809,042 B2
(45) Date of Patent: Oct. 20, 2020

(54) TARGET DEVICE FOR USE IN A LIVE FIRE TRAINING EXERCISE AND METHOD OF OPERATING THE TARGET DEVICE

(71) Applicant: Marathon Robotics Pty Ltd, New South Wales (AU)

(72) Inventors: Alex Brooks, Newtown (AU); Tobias Kaupp, St. Peters (AU); Alexei Makarenko, Erskineville (AU)

(73) Assignee: Marathon Robotics Pty Ltd, Hornsby (AU)

( * ) Notice: Subject to any disclaimer, the term of this patent is extended or adjusted under 35 U.S.C. 154(b) by 0 days.

(21) Appl. No.: 15/767,946

(22) PCT Filed: Sep. 29, 2016

(86) PCT No.: PCT/AU2016/050909
§ 371 (c)(1),
(2) Date: Apr. 12, 2018

(87) PCT Pub. No.: WO2017/083906
PCT Pub. Date: May 26, 2017

(65) Prior Publication Data

US 2018/0299233 A1 Oct. 18, 2018

(30) Foreign Application Priority Data

Nov. 17, 2015 (AU) ..... 2015904730
Nov. 30, 2015 (AU) ..... 2015904949

(51) Int. Cl.
*F41J 9/02* (2006.01)
*F41J 5/18* (2006.01)
(Continued)

(52) U.S. Cl.
CPC . *F41J 9/02* (2013.01); *F41J 1/10* (2013.01); *F41J 5/18* (2013.01); *F41J 7/04* (2013.01)

(58) Field of Classification Search
CPC . F41J 1/00; F41J 1/10; F41J 9/00; F41J 9/02; F41J 5/18; F41J 7/04
(Continued)

(56) References Cited

U.S. PATENT DOCUMENTS 547,141 A 10/1895 Crutchfield
2,726,870 A * 12/1955 Auger ..... F41J 9/02 273/370
(Continued)

FOREIGN PATENT DOCUMENTS

EP 0676612 A1 10/1995

OTHER PUBLICATIONS

Robotic Smart Targets—Realism, Complexity, Flexibility [Viewed on Internet on Nov. 3, 2016] Viewed on internet. <URL:https://www.youtube.com/watch?v=6G1ufkiQXrM>, Published on Aug. 22, 2012.
(Continued)

*Primary Examiner* — Jeffrey S Vanderveen
(74) *Attorney, Agent, or Firm* — Greenberg Traurig, LLP

(57) ABSTRACT

A target device for use in training armed personnel is described including: a base portion which includes locomotion means for propelling the target around in a training area; a humanoid target is mounted in association with the base portion; the humanoid target adopts a normally upright position and is controllable to move to adopt a range of rotational positions away from the normally upright position in both of a forwards direction and a backwards direction.

18 Claims, 6 Drawing Sheets

(51) Int. Cl.
*F41J 7/04* (2006.01)
*F41J 1/10* (2006.01)

(58) Field of Classification Search
USPC ..... 273/359, 366–370, 406, 390–392
See application file for complete search history.

(56) References Cited

U.S. PATENT DOCUMENTS 3,082,002 A * 3/1963 Goldfarb ..... F41J 9/02 273/368
3,160,983 A * 12/1964 Smith ..... A63H 11/10 273/359
5,947,477 A * 9/1999 Turnipseed ..... F41J 1/10 273/359
7,900,927 B1 * 3/2011 Bliehall ..... F41J 9/02 273/359
8,006,981 B2 * 8/2011 Gibson ..... F41J 9/02 273/359
8,712,602 B1 * 4/2014 Oliver ..... F41H 7/005 701/1
8,713,846 B1 * 5/2014 Thrash ..... A01M 31/06 43/2
9,797,694 B1 * 10/2017 Cummins ..... F41J 1/10
9,915,507 B1 * 3/2018 Cummins ..... F41J 1/10
9,943,070 B1 * 4/2018 Allen ..... A01K 15/027
10,101,134 B2 * 10/2018 Chavez ..... F41J 9/02
2007/0105070 A1 * 5/2007 Trawick ..... F41A 23/10 434/11
2008/0150235 A1 * 6/2008 Bliehall ..... A63B 63/06 273/359
2011/0089639 A1 * 4/2011 Bellamy ..... F41J 9/02 273/359
2012/0171644 A1 7/2012 Moser
2012/0208150 A1 * 8/2012 Spychaiski ..... F41H 7/005 434/20
2013/0341869 A1 * 12/2013 Lenoff ..... F41J 9/02 273/406
2016/0018198 A1 * 1/2016 Pettey ..... F41J 9/02 273/406

OTHER PUBLICATIONS

International Search Report dated Nov. 22, 2016 for PCT/AU2016/050909, four (4) pages.
Written Opinion dated Nov. 22, 2016 for PCT/AU2016/050909, four (4) pages.

* cited by examiner

TARGET DEVICE FOR USE IN A LIVE FIRE TRAINING EXERCISE AND METHOD OF OPERATING THE TARGET DEVICE

CROSS REFERENCE TO RELATED APPLICATION

The present application is a 371 U.S. National Stage of International Application No. PCT/AU2016/050909, filed Sep. 29, 2016, which claims the benefit of the earlier filing date of Australian Patent Application Nos. 2015904730 filed on Nov. 17, 2015 and 2015904949 filed on Nov. 30, 2015, which are each incorporated herein by reference in their entirety.

TECHNICAL FIELD

The present invention relates to target devices for use in live fire training exercises and to method of operating target devices.

BACKGROUND TO THE INVENTION

Armed personnel such as soldiers typically receive training to assist them in dealing with armed combat situations that they might encounter during their active duties. Such training can include training exercises using live ammunition such as practice in shooting at targets. Such training is crucial to the personnel's performance and safety in real life situations.

To date, such training has involved the use of static shooting targets, pop-up targets, and targets moved on tracks. In some cases, mobile targets have been used in the form of a mannequin or the like mounted on a moveable platform on wheels. These may be directly radio-controlled by a human operator during a training exercise. In other cases, the mobile targets are autonomous and the target's onboard computer generates the route for the target to follow. However, there remains a need for improved systems and methods for training armed personnel to provide training exercises with greater realism and therefore improved effectiveness.

SUMMARY OF THE INVENTION

In a first aspect the present invention provides a target device for use in training armed personnel including: a base portion which includes locomotion means for propelling the target around in a training area; a humanoid target is mounted in association with the base portion; the humanoid target adopts a normally upright position and is controllable to move to adopt a range of rotational positions away from the normally upright position in both of a forwards direction and a backwards direction.

Optionally, the humanoid target is arranged to move forwards when the target device is accelerating.

Optionally, the degree of movement of the humanoid target is based on the rate of acceleration.

Optionally, the humanoid target is arranged to move backwards when the target device is decelerating.

Optionally, the degree of movement of the humanoid target is based on the rate of deceleration.

Optionally, the humanoid target is arranged to move forwards when the target device is moving up an incline.

Optionally, the degree of movement of the humanoid target is based on the gradient of the incline.

Optionally, the humanoid target is arranged to move backwards when the target device is moving down an incline.

Optionally, the degree of movement of the humanoid target is based on the gradient of the incline.

Optionally, the humanoid target is arranged to move alternately forwards and backwards when the target device is moving over uneven ground.

Optionally, the target device is arranged to indicate a non-fatal hit.

Optionally, a non-fatal hit is indicated by the humanoid target moving temporarily either forwards or backwards.

In a second aspect the present invention provides a method of operating a target device according to the first aspect of the invention including the steps of: moving the humanoid target forwards to indicate that the humanoid target is crouching; and moving the humanoid target backwards to a substantially horizontal position to indicate that the humanoid target has been hit.

In a third aspect the present invention provides a method of operating a target device according to the first aspect of the invention including the steps of moving the humanoid target temporarily either forwards or backwards to indicate that the target has received a non-fatal hit.

BRIEF DESCRIPTION OF THE DRAWINGS

An embodiment of the present invention will now be described, by way of example only, with reference to the accompanying drawings, in which.

DETAILED DESCRIPTION OF THE PREFERRED EMBODIMENT

Figure 1:
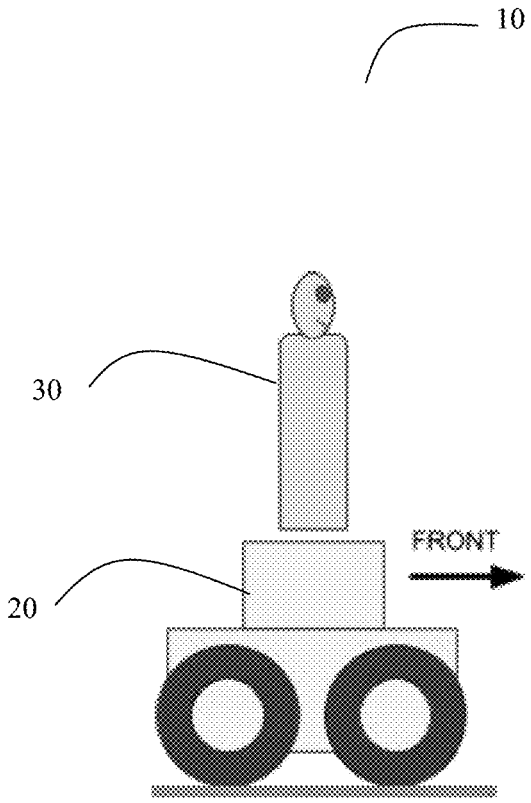
FIG. 1 is a side view of an autonomous robotic target.

Referring to FIG. 1, a target device is shown in the form of an autonomous robotic target 10. The target includes a base portion in the form of base 20 which includes locomotion means in the form of four wheels which are driven and controllable to propel the robotic target around in a training area. The target further includes a humanoid target portion in the form of mannequin 30 which is pivotally mounted to the base 20 by way of a mechanism which includes actuators which can move the mannequin by pivoting the mannequin forwards or backwards. The pivoting mechanism can be actuated using a commercial electric motor in conjunction with a suitable gearbox.

Base 20 houses electronic equipment and systems for communication and control of the target as described in applicant's International Patent application no PCT/AU2010/001165 (published as WO/2011/035363), the contents of which are incorporated herein by reference. Base 20 includes a commercially available Inertial Measurement Unit (IMU) consisting of accelerometers to measure 3d acceleration and gyros to measure 3d rotations.

Mannequin 30 is shown in FIG. 1 in a normally upright position facing forwards. Although the base 20 is controllable to move either forwards or backwards, the predominant direction of the target during a training exercise is in the forwards direction to give a realistic effect as humans normally move forwards, in the direction that they are facing.

Figure 8:
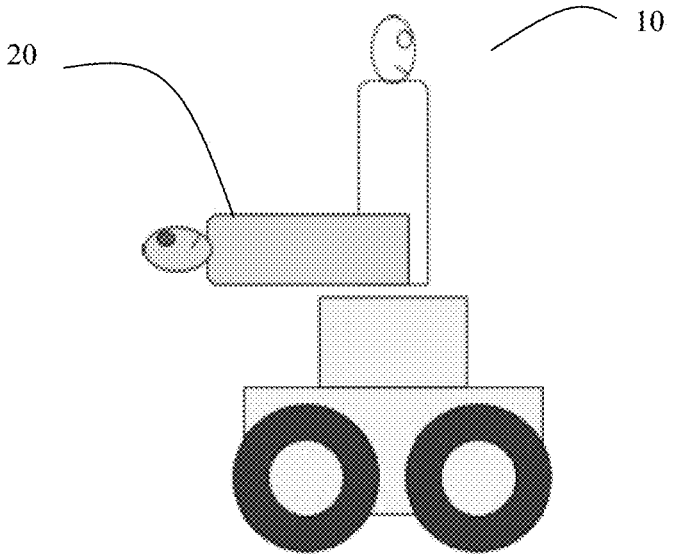
FIGS. 8 and 9 show the target of FIG. 1 in the fully reclined and fully forward positions respectively.

The position of the mannequin is able to be maintained at any point between a fully forwards horizontal (see FIG. 9) position and a fully reclined backwards horizontal position (see FIG. 8). The position of the mannequin is controllable to give various visual cues which enhance the realism of the scene by endowing the target with natural human movements.

Figure 2:
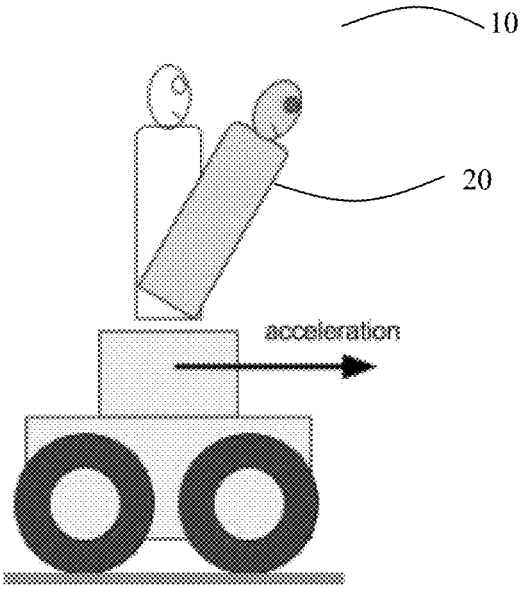
FIG. 2 shows the target of FIG. 1 accelerating.
Figure 3:
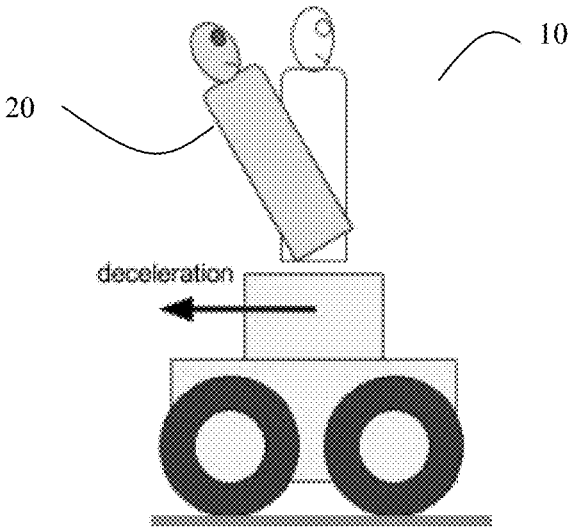
FIG. 3 shows the target of FIG. 1 decelerating.

Referring to FIGS. 2 and 3, movements of the mannequin in response to acceleration of the target 10 are shown. Based on the output of the IMU, if the target is accelerating then the mannequin leans forward (FIG. 2). If the target 10 is decelerating then the mannequin leans backwards (FIG. 3). The degree of lean of the mannequin either forwards or backwards is controlled based on the measured rate of acceleration or deceleration.

Human runners must lean forward when accelerating in order to preserve the balance of forces acting on the body. If a runner attempts to accelerate with the body upright he or she would fall backwards. When decelerating, the body must be leaned backwards. These adjustments are performed automatically by the runner and appear very natural and familiar to a human observer. Human observers also readily notice the lack of such leaning patterns and regard it as unnatural.

Statically stable target devices, such as the four-wheel base 20 in FIG. 1, are much more stable than humans and do not typically need to adjust their posture when changing speed. But by leaning the target back and forth the target appears more natural and improves realism of training.

Figure 4:
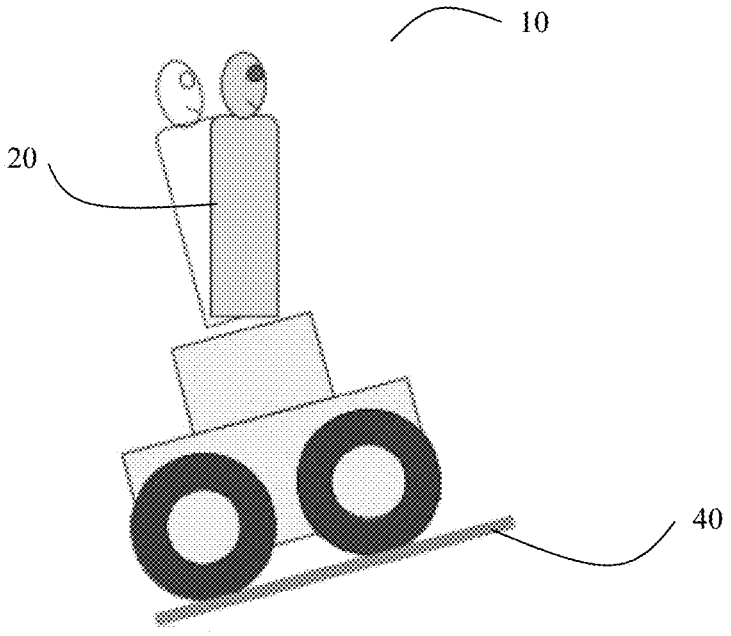
FIG. 4 shows the target of FIG. 1 moving up an incline.
Figure 5:
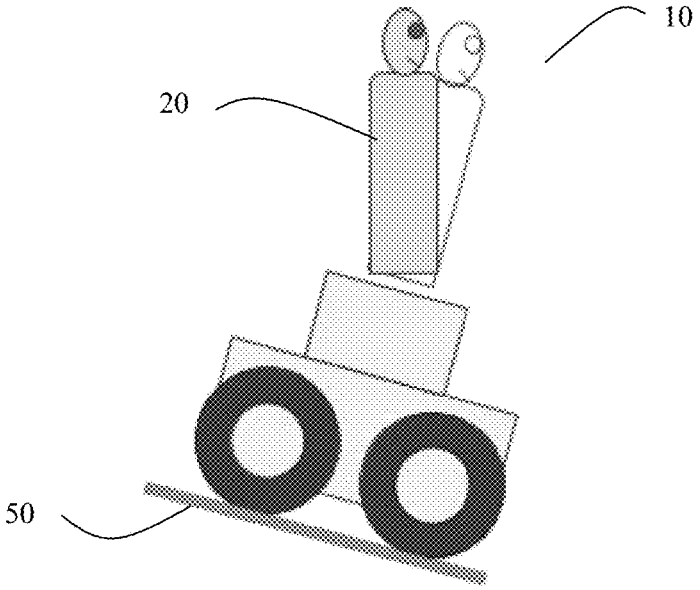
FIG. 5 shows the target of FIG. 1 moving down an incline.

Referring to FIGS. 4 and 5, movement of the mannequin in response to changes in the attitude of the target 10 are shown. Based on the output of the IMU, if the target is moving up an incline 40 then the mannequin pivots forward with respect to base 20 (FIG. 4). If the target 10 is moving down an incline 50 then the mannequin pivots backwards with respect to base 20 (FIG. 5). The degree of movement of the mannequin either forwards or backwards is controlled based on the measured angle of attitude of the base of target 20 and hence is based on the angle of the incline. The degree of movement applied corresponds to the angle of the incline to thereby maintain the mannequin in a generally upright position with respect to the normal direction of the force of gravity. This gives the target a more natural human impression because humans normally stay generally upright with respect to the direction of the force of gravity when they are walking up or down inclines.

Figure 6:
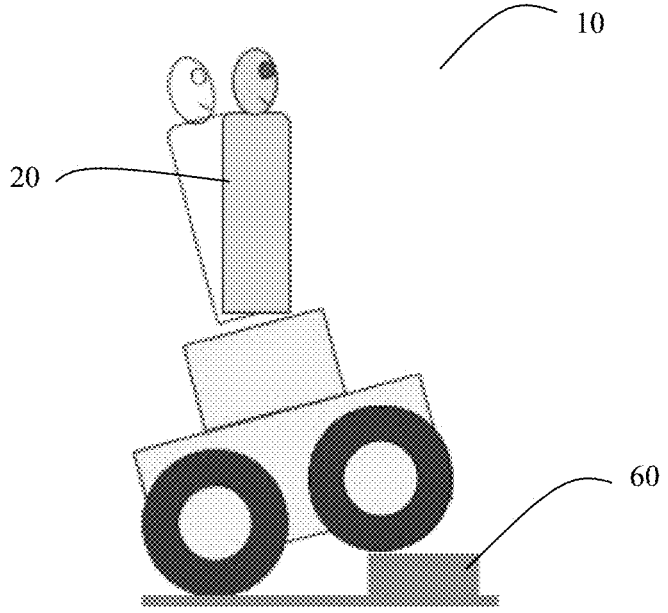
FIGS. 6 and 7 shows the target of FIG. 1 negotiating an obstacle.
Figure 7:
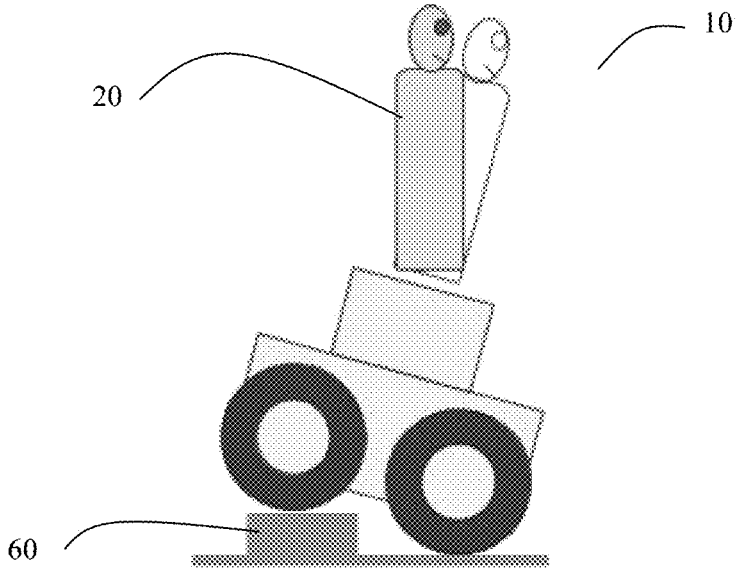

Referring to FIGS. 6 and 7, movement of the mannequin in response to moving over uneven ground is shown illustrated by the target moving along substantially flat ground and over an obstacle 60. The control loop used is the same as that used in respect of moving up and down inclines. The system must be designed so that it can respond quickly enough to respond to the transient event of negotiating the obstacle 60. Based on the output of the IMU, as the target firstly mounts the obstacle 60 the mannequin pivots forwards (FIG. 6), as the target descends from the obstacle 60 then the mannequin pivots backwards (FIG. 7). The degree of movement of the mannequin either forwards or backwards is controlled based on the measured angle of attitude of the base of target 20 and hence is based on the size of the obstacle. This gives the target a more natural human impression because humans "stabilise" (manage to stay upright) when they are negotiating uneven terrain or small obstacles in their path.

Figure 9:
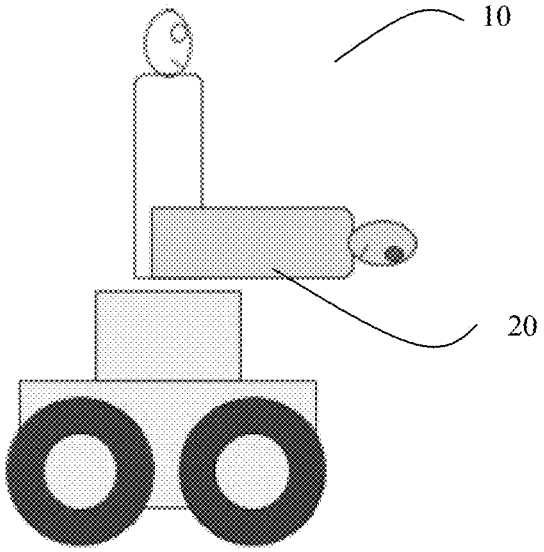
Figure 10A:
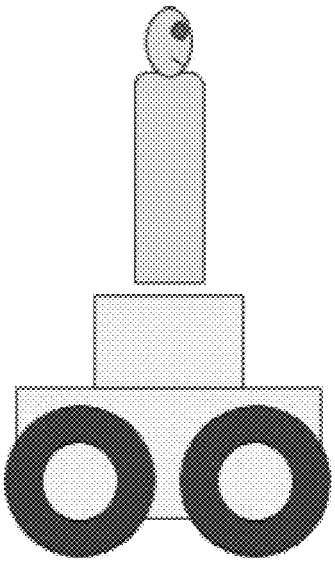
FIGS. 10A to 10D show one possible sequence of movements by the target of FIG. 1 which indicate that the target has received a non-lethal hit.
Figure 10B:
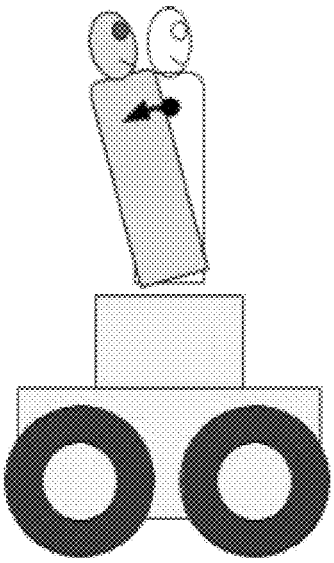
Figure 10C:
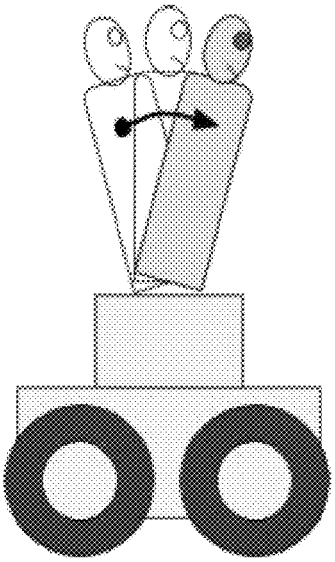
Figure 10D:
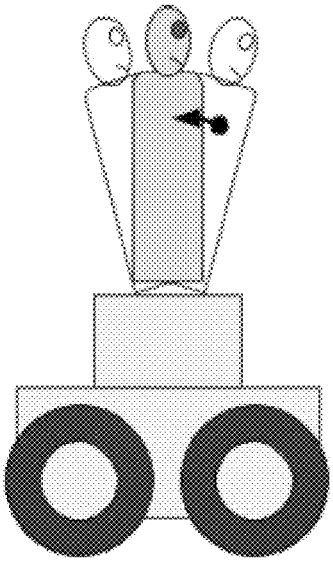

Referring to FIGS. 8 and 9, the target 10 can be operated using a convention assigned to the significance of the fully reclined position shown in FIG. 8 and the fully forward position shown in FIG. 9. The fully reclined position is assigned the significance of the target being hit (i.e. dead). The fully forward position is assigned the significance of the target crouching. This enables the target to be controlled to act out scenarios where the target can crouch to hide behind half height objects like cars or low fences (as a real soldier would do) without giving a false indication of being hit.

The movements of the mannequin shown in FIGS. 2 to 7 are carried out autonomously by the target using the output of its own IMU module.

The movement of the mannequin to the position shown in FIG. 8 can be made based on the output of a hit detection system mounted on the target. Similarly, the movement of the mannequin to the position shown in FIG. 8 can be made as a result of an instruction to the target to play out a certain scenario in which it is deemed to have been hit, or the movement can be made as a result of a remote control instruction to the target.

The movement of the mannequin to the position shown in FIG. 9 can be made autonomously by the target. If the target has "knowledge" of the height of an obstacle, and the direction of persons who are attempting to hit the target then it can autonomously use objects to crouch behind. Similarly, the target can be remotely controlled by a human operator to adopt the position shown in FIG. 9.

Referring to the sequence of FIGS. 10A to 10D movement of the mannequin in response to a non-fatal (i.e. wounding) hit is shown illustrated by the target moving partially backwards, then partially forward, then restoring to the vertical position. The wobbling motion following a hit is assigned the significance of the target receiving a non-fatal (i.e. wounding) hit. The logic of deciding which hit is wounding and which one is fatal can be performed in software and made configurable to suit training objectives. In both cases of wounding and fatal hits it is beneficial for training outcomes to be able to indicate to the shooter that the target was hit and if the hit was wounding or fatal.

A variety of movement patterns which can be used to indicate the wounding hit. One pattern is lean back, lean forward, restore to vertical as described above and shown in FIGS. 10A to 10D. Another possible pattern is lean forward or back, restore to vertical. Yet another possible pattern is lean back, lean forward and remain in a leaning position. The pattern can be repeated several times. The speed of the wobble and the depth of the lean can also be varied.

The target includes a hit detection system for detecting hits on the target. The target may be configured to "die" after several hits, e.g. 3. Then the first 2 recorded hits will be wounding and the 3rd one will be fatal.

If the hit detection system is capable of sensing the location of the hit, then it is possible to discriminate between a hit in the vital parts vs non-vital. In this case the target software can be configured to "die" on the 1st hit in the vital zone and after several non-vital hits, e.g. 5.

It can be seen that embodiments of the invention provide for various enhanced realistic movements of humanoid targets for use in weapons training of personnel.

Any reference to prior art contained herein is not to be taken as an admission that the information is common general knowledge, unless otherwise indicated.

Finally, it is to be appreciated that various alterations or additions may be made to the parts previously described without departing from the spirit or ambit of the present invention.

The invention claimed is:

1. A target device for use in training armed personnel comprising:

a base portion comprising locomotion means for propelling the target around in a training area and internally houses electronic equipment for control of the target; and a humanoid target mounted to the base portion by a pivoting mechanism that provides for independent movement of the humanoid target relative to the base portion, wherein:

the humanoid target adopts a normally upright position and the pivoting mechanism is controllable by an actuator to move the humanoid target rotationally with respect to the base to adopt a range of rotational positions away from the normally upright position in both of a forwards direction and a backwards direction without corresponding movement of the base portion, the actuator is configured to control the rotational movement of the humanoid target to rotate in the forwards direction while the target device is accelerating in the forwards direction, and the actuator is configured to control the rotational movement of the humanoid target to rotate in the backwards direction while the target device decelerating in the backwards direction.

2. The target device according to claim 1, wherein the degree of movement of the humanoid target is based on the rate of acceleration.

3. The target device according to claim 1, wherein the degree of movement of the humanoid target is based on the rate of deceleration.

4. The target device according to claim 1, wherein the humanoid target is arranged to move forwards when the target device is moving up an incline.

5. The target device according to claim 4, wherein the degree of movement of the humanoid target is based on the gradient of the incline.

6. The target device according to claim 1, wherein the humanoid target is arranged to move backwards when the target device is moving down an incline.

7. The target device according to claim 6, wherein the degree of movement of the humanoid target is based on the gradient of the incline.

8. The target device according to claim 1, wherein the humanoid target is arranged to move alternately forwards and backwards when the target device is moving over uneven ground.

9. The target device according to claim 1, wherein the target device is arranged to indicate a non-fatal hit.

10. The target according to claim 9, wherein a non-fatal hit is indicated by the humanoid target moving temporarily either forwards or backwards.

11. A method of operating a target device according to claim 1, comprising the steps of:

moving the humanoid target forwards to indicate that the humanoid target is crouching; and moving the humanoid target backwards to a substantially horizontal position to indicate that the humanoid target has been hit.

12. A method of operating a target device according to claim 1, comprising the steps of moving the humanoid target temporarily either forwards or backwards to indicate that the target has received a non-fatal hit.

13. A method of operating a target device according to claim 1, comprising the steps of:

moving the humanoid target to a substantially vertical position to make it invisible to the armed personnel; and moving the humanoid target forwards or backwards to make it visible to the armed personnel.

14. The target device according to claim 1, wherein the range of rotational positions away from the normally upright position includes a discreet number of intermediate positions.

15. The target device according to claim 1, wherein the humanoid target is controllable to move to a first fully horizontal rotational position such that the humanoid target is generally parallel to a ground.

16. The target device according to claim 15, wherein the humanoid target is controllable to move to a second fully horizontal rotational position such that the humanoid target is generally parallel to the ground, further wherein the first fully horizontal rotational position is in the forwards direction from the normally upright position and the second fully horizontal rotational position in the backwards direction from the normally upright position.

17. The target device according to claim 1, wherein the humanoid target is controllable to move around an axis that is parallel to a ground to adopt the range of rotational positions.

18. The target device according to claim 1, wherein the locomotion means comprises at least one wheel having a first axis of rotation, the humanoid target is controllable to move along a second axis to adopt the range of rotational positions, and the first axis is parallel to the second axis.

* * * * *